United States Patent [19]

Starks et al.

[11] Patent Number: 4,902,000

[45] Date of Patent: Feb. 20, 1990

[54] TODDLER WALKING TRAINER

[76] Inventors: Robert D. Starks; John H. Starks, Jr.; Nolas Zarate, all of 81 So. 24th St., Kansas City, Kans. 66102

[21] Appl. No.: 310,887

[22] Filed: Feb. 16, 1989

[51] Int. Cl.[4] ..... A63B 1/00

[52] U.S. Cl. ..... 272/70; 272/63; 272/900; 434/255

[58] Field of Search ..... 272/62, 63, 70, 900; 434/255; 248/225.1, 503.1

[56] References Cited

U.S. PATENT DOCUMENTS

| | | | |
|---|---|---|---|
| 761,514 | 5/1904 | Leininger | 272/70 |
| 1,222,664 | 4/1917 | Perna | 272/70 |
| 1,642,184 | 9/1927 | Urso | 272/70.3 |
| 2,690,789 | 10/1954 | Zadrozny | 272/70 |
| 2,871,914 | 2/1959 | Timoney | 272/70 |
| 2,944,815 | 7/1960 | Moyer | 272/62 |
| 3,896,798 | 7/1975 | Simon | 272/63 |
| 3,958,801 | 5/1976 | Correa | 272/63 |

FOREIGN PATENT DOCUMENTS

| | | | |
|---|---|---|---|
| 58464 | 2/1891 | Australia | 272/63 |
| 336522 | 3/1904 | France | 272/63 |
| 2435955 | 5/1980 | France | 272/63 |

*Primary Examiner*—Richard J. Apley
*Assistant Examiner*—D. Crosby
*Attorney, Agent, or Firm*—Leon Gilden

[57] ABSTRACT

A toddler walking trainer is set forth utilizing a plurality of rails telescopingly mounted within support posts. The support posts and rails are encased in a resilient covering to enhance safety and comfort to a toddler utilizing the device. The support posts are mounted onto a "U" shaped rigid clamp reciprocatably mounted relative to an opposed "U" shaped clamp of an opposed support rail and post slidably received within a connecting member to grasp a resilient mat therebetween to provide safety and comfort to a toddler utilizing the device.

4 Claims, 1 Drawing Sheet

TODDLER WALKING TRAINER

BACKGROUND OF THE INVENTION

1. Field of the Invention

The field of invention relates to infant training devices, and more particularly pertains to a new and improved toddler walking trainer wherein the same may be compactly stored during periods of non-use and may be readily and effectively assembled to enable utilization by a toddler in a training procedure for walking.

2. Description of the Prior Art

The use of various toddler and infant training devices to assist such individuals in exercise and training to accomplish walking have been provided by the prior art. The prior devices have generally been of elaborate and expansive organizations that have been of limited application in providing a convenient and effective training structure for use by an infant. For example, U.S. Pat. No. 761,514 to Leininger sets forth an infant walker wherein the same provides for a slidably mounted tray provided with an opening therethrough for securement of an infant to enable the infant to be propped up in a walking orientation. The Leininger patent does not assist an infant in developing arm and leg strength and coordination, as does the instant invention.

U.S. Pat. No. 1,222,664 to Perna is of an organization similar to that of the Leininger patent utilizing a slidable tray mounted within a plurality of spaced rails to enable an infant to be propped up in a walking mode.

U.S. Pat. No. 1,642,184 to Urso utilizes a yoke or safety belt secured to an overlying beam that is movably mounted relative to the beam to enable an infant to develop a walking ability.

U.S. Pat. No. 2,690,789 to Zadrozny sets forth a parallel bar arrangement utilizing a telescoping pair of associated rails wherein the patent fails to provide the requisite padding to the associated rails as well as securement to an associated underlying mat to provide for safety and comfort of a toddler utilizing the device.

U.S. Pat. No. 2,871,914 to Timoney sets forth a baby walking type trainer utilizing a belt slidably mounted on parallel opposed rails to enable an infant to be maintained in an upright position in the traverse of stairs and a platform.

As such, it may be appreciated that there is a continuing need for a new and improved toddle walking trainer wherein the same addresses both the problems of ease of use and effectiveness in construction, and in this respect, the present invention substantially fulfills this need.

SUMMARY OF THE INVENTION

In view of the foregoing disadvantages inherent in the known types of walking trainers now present in the prior art, the present invention provides a toddler walking trainer wherein the same may be compactly stored during periods of non-use and may be readily erected and positioned in securement of a centrally oriented underlying mat to provide comfort and safety to an infant. As such, the general purpose of the present invention, which will be described subsequently in greater detail, is to provide a new and improved toddler walking trainer which has all the advantages of the prior art toddler walking trainers and none of the disadvantages.

To attain this, the present invention sets forth a toddler walking trainer utilizing a pair of padded spaced parallel rails telescopingly mounted within padded support posts wherein each post is secured at lower terminal ends thereof to a "U" shaped rigid clamp with a lower flange of the "U" shaped clamp of a greater width than the upper flange to slidably be received within a connecting member orienting and connecting opposed pairs of the rigid "U" shaped clamps for securement of an associated resilient mat therebetween.

My invention resides not in any one of these features per se, but rather in the particular combination of all of them herein disclosed and claimed it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toddler walking trainer which has all the advantages of the prior art toddler walking trainers and none of the disadvantages.

It is another object of the present invention to provide a new and improved toddler walking trainer which may be easily and efficiently manufactured and marketed.

It is a further object of the present invention to provide a new and improved toddler walking trainer which is of a durable and reliable construction.

An even further object of the present invention is to provide a new and improved toddler walking trainer which is susceptible of a low cost of manufacture with regard to both materials and labor, and which accordingly is then susceptible of low prices of sale to the consuming public, thereby making such toddler walking trainer economically available to the buying public.

Still yet another object of the present invention is to provide a new and improved toddler walking trainer which provides in the apparatuses and methods of the prior art some of the advantages thereof, while simultaneously overcoming some of the disadvantages normally associated therewith.

Still another object of the present invention is to provide a new and improved toddler walking trainer wherein the same is provided with opposed rigid clamps for securement of a resilient safety mat therebetween while providing for telescopingly positionable parallel rails for manual grasping and support of an infant.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
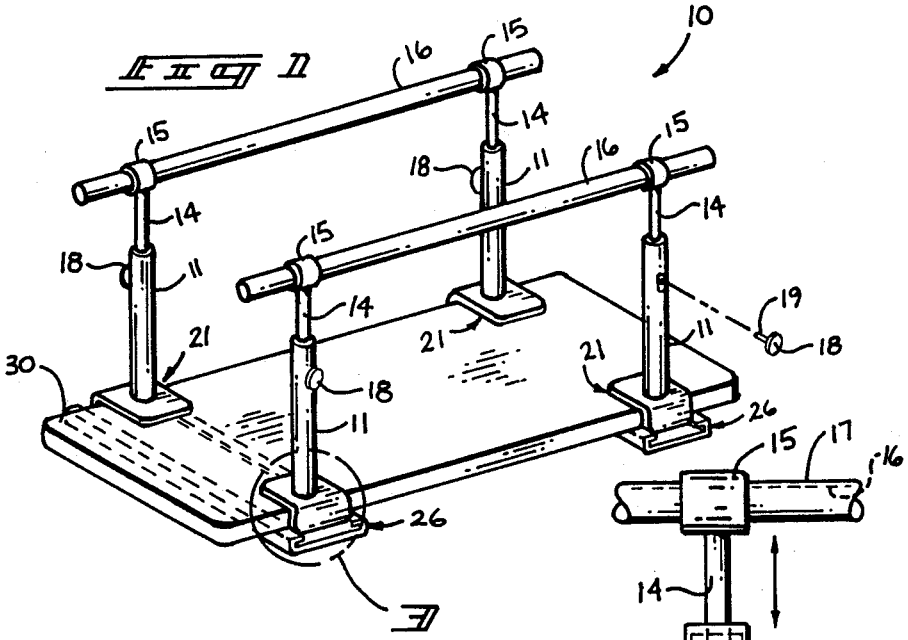
FIG. 1 is an isometric illustration of the instant invention.
Figure 3:
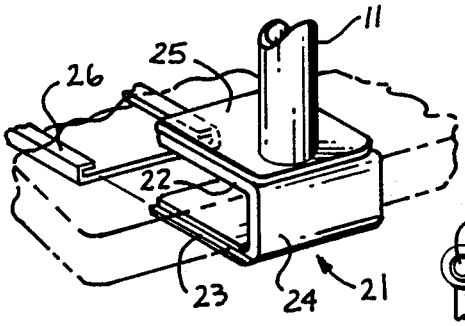
FIG. 3 is an enlarged isometric illustration of the rigid "U" shaped clamp utilized by the instant invention.
Figure 2:
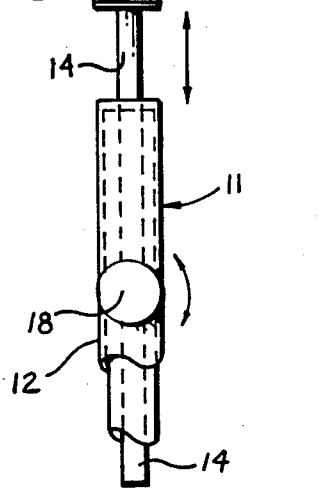
FIG. 2 is an orthographic view taken in elevation, somewhat expanded, of the padded support posts and rail structure of the instant invention.
Figure 5:
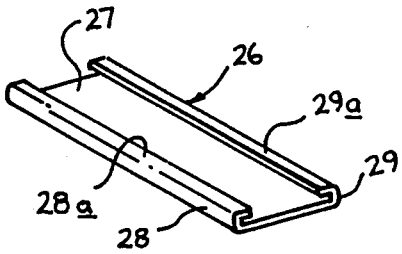
FIG. 5 is an isometric illustration of the connecting member utilized by the instant invention.

With reference now to the drawings, and in particular to FIGS. 1 to 5 thereof, a new and improved toddler walking trainer embodying the principles and concepts of the present invention and generally designated by the reference numeral 10 will be described.

Figure 4:
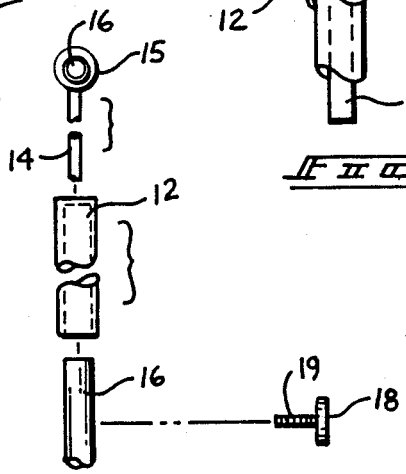
FIG. 4 is an orthographic view taken in elevation, somewhat expanded, of the support posts, reciprocating rod, and securement member therefore.

More specifically, it will be noted that the toddler walking trainer of the instant invention essentially comprises plural pairs of aligned support posts 11 including reciprocatably mounted rods 14 mounted from within the support posts 11 securing connecting rails 16 within loops 15 integrally secured to upper terminal ends of the rods 14. The support posts 11 are formed with first resilient coverings 12 slidably positionable over the posts 11, as illustrated in FIG. 4 for example, defining a hollow cylindrical interior with an upper web **12*a* formed with an aperture for slidingly allowing passage of the reciprocating rods 14. The connecting rails 16 are provided with a second resilient covering 17** to provide enhanced safety and comfort for use of a toddler or infant.

The reciprocating rods 14 are mounted within the support posts 11 by a securement member 18 formed with an outwardly extending threaded rod 19 received within a threaded aperture 20 formed within each respective support post 11 to enable frictional engagement of the respective rods 14 as they are varied in height above the upper webs of the rigid "U" shaped clamps 21 to provide a height of fifteen inches to eighteen inches of each respective rails 16 above the upper webs 22 of each rigid "U" shaped clamp 21. A lower web 23 is positioned parallel to and underlying each upper web 22 and is of a width greater than the upper web 22 to define outwardly extending flanges relative to the upper web 22 and the connecting flange 24 that is orthogonally oriented relative to the upper and lower webs wherein the outwardly extend flanges receive a connecting member 26 to enable securement of the resilient mat 30 between opposed pairs of "U" shaped clamps 21. Each "U" shaped clamp is formed with a resilient top sheet 25 to further enhance safety in use of the instant invention.

The connecting member 26 is formed with a planar base 27 including upwardly extending right and left "L" shaped flanges 28 and 29 with respective top legs **28*a* and 29*a*, each parallel and overlying the base 27**.

It may be appreciated therefore that the mat 30 is thereby securably grasped between each opposed pair of "U" shaped clamps 21 wherein each opposed pair of "U" shaped clamps are part of a complementary pair of "U" shaped clamps associated with a single overlying connecting rail 16.

As to the manner of usage and operation of the instant invention, the same should be apparent from the above description and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toddler walking trainer apparatus comprising, in combination, a first horizontal rail spaced from a second horizontal rail, and each rail including a rod pair including a first and second spaced rod orthogonally secured at an upper terminal end of each rod to a respective first and second rail, and each first and second rod slidably mounted within a respective first and second support post, and the respective first support posts aligned relative to one another, and the respective second support post aligned relative to one another, and each first and second support post secured at a lowermost end to a rigid "U" shaped jaw, and opposed "U" shaped jaws secured to the spaced first and second posts to comprise a clamp pair, and wherein each clamp pair is slidingly received within and aligned by a connecting member, and a resilient mat secured and received within each "U" shaped jaw of each clamp pair and positioned between the opposing "U" shaped jaws to provide a protective cushion surface below the rails.

2. A toddler walking trainer apparatus as set forth in claim 1 wherein each "U" shaped jaw includes an upper rigid web of a first width parallel to and overlying a lower rigid web of a second width wherein said second width is greater than the first width to define flanges on said lower web extending outwardly beyond the width of the upper web, and wherein the flanges are slidingly received within the connecting member.

3. A toddler walking trainer apparatus as set forth in claim 2 wherein the connecting member comprises a planar base and a right and left "L" shaped flange receiving the lower web between the right and left "L" shaped flange wherein each "L" shaped flange includes a top leg overlying the base of the connecting member.

4. A toddler walking trainer apparatus as set forth in claim 3 wherein the upper web of each "U" shaped jaw, each support post and each rail includes a resilient covering, and each support post resilient covering includes an aperture for adjustment of each rod therethrough.

* * * * *